US005648840A

United States Patent [19]

Ikunami et al.

[11] Patent Number: 5,648,840

[45] Date of Patent: Jul. 15, 1997

[54] IMAGE FORMING APPARATUS INCLUDING TONER CONVEYANCE APPARATUS

[75] Inventors: Yoshikazu Ikunami; Kazuyoshi Kimura, both of Hachioji, Japan

[73] Assignee: Konica Corporation, Japan

[21] Appl. No.: 555,092

[22] Filed: Nov. 8, 1995

[30] Foreign Application Priority Data

Nov. 14, 1994 [JP] Japan ..... 6-279068
Nov. 15, 1994 [JP] Japan ..... 6-280468

[51] Int. Cl.[6] ..... G03G 15/00; G03G 15/01

[52] U.S. Cl. ..... 399/262; 399/119; 399/223

[58] Field of Search ..... 355/260, 245, 355/326 R; 118/645

[56] References Cited

U.S. PATENT DOCUMENTS 4,746,951 5/1988 Hayakawa et al. ..... 355/245
4,928,144 5/1990 Kasahara et al. ..... 355/245
5,045,884 9/1991 Ohira et al. ..... 355/245
5,298,946 3/1994 Haneda et al. ..... 355/326 R
5,495,323 2/1996 Meetze, Jr. ..... 355/260
5,537,188 7/1996 Haneda ..... 355/326 R

*Primary Examiner*—Arthur T. Grimley
*Assistant Examiner*—Sophia S. Chen
*Attorney, Agent, or Firm*—Jordan B. Bierman; Bierman, Muserlian & Lucas LLP

[57] ABSTRACT

An image forming apparatus includes a plurality of toner reservoir for storing different toner, a developing unit composed of a plurality of developing devices, and a plurality of toner conveyors for conveying toner from the toner reservoir to the developing unit. Through-holes are formed in the developing unit, and an upper portion of each through-hole is connected with each toner conveyor in such a manner that an upper opening of each through-hole is opposed to an ejection port of each toner conveyor, so that toner drops from the toner conveyor into through-hole and is guided to each developing device.

9 Claims, 8 Drawing Sheets

FIG. 8 ( A )
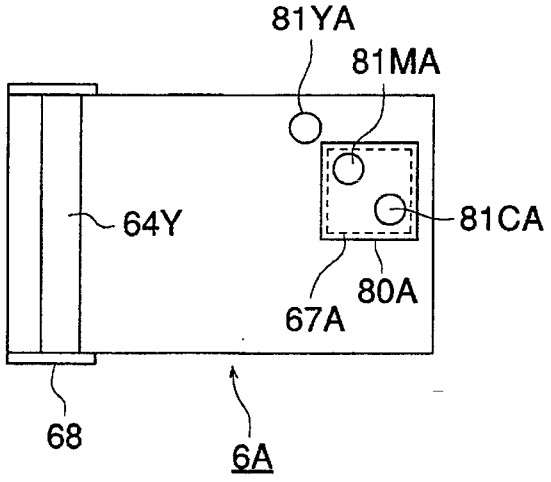
FIG. 8 ( B )
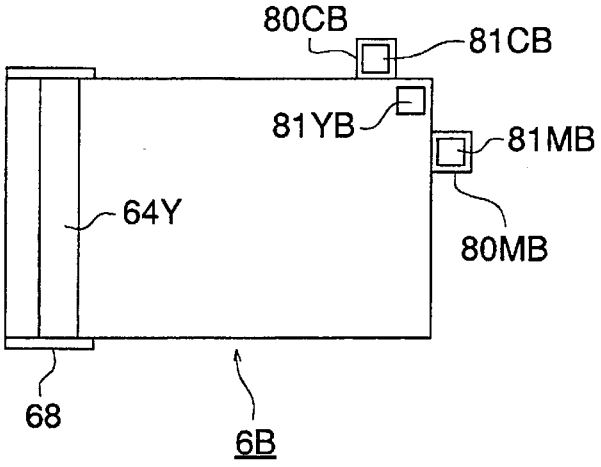
FIG. 8 ( C )
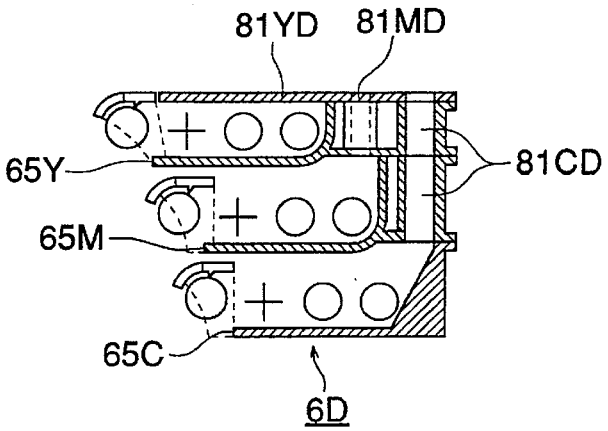

IMAGE FORMING APPARATUS INCLUDING TONER CONVEYANCE APPARATUS

BACKGROUND OF THE INVENTION

The present invention relates to an image forming apparatus in which different toners are used to form a toner image and the thus formed toner image is fixed onto a recording sheet. More particularly, the present invention relates to a toner supply mechanism for supplying toner to a plurality of developing units in which development is conducted with different toners.

In order to reduce the size and cost of the image forming apparatus described above, the diameter of the image forming body is reduced and the size of the developing unit is also reduced. For the purpose of downsizing the developing unit, it is effective that the toner supply means is attached to the developing unit.

One of the examples of the developing units to which the toner supply means is attached is described as follows. A toner feed means for feeding toner is provided in a lower portion of a toner hopper. The thus formed toner supply means is directly connected with an upper portion of the developing unit. The above developing unit has several disadvantages, which will be described as follows. In the above developing unit, height of the toner supply means is increased. Therefore, it is difficult to downsize the image forming apparatus. Toner is supplied to the toner supply means in such a manner that toner is moved from a toner container to a toner hopper. At this time, toner tends to be spilt. In the case of an image forming apparatus in which a plurality of developing units are arranged around the image forming body, it is necessary to arrange a plurality of developing units on one side of the image forming body. In this case, the number of developing units arranged on one side of the image forming body is limited to 2 due to the limitation of the toner supply means. Further, capacities of the 2 toner supply means tend to be unbalanced.

The other of the examples of the developing units to which the toner supply means is attached is described as follows. A toner feed means of the toner supply means is composed of a toner conveyance screw arranged in a lower portion of the toner hopper, and a toner ejection port arranged on a side wall of the toner hopper on the conveyance end side. In this case, the toner ejection port is connected with the developing unit via a connection pipe. According to the above structure, degree of freedom of the position of the toner supply means with respect to the developing unit is increased by the connection pipe. Therefore, the number of developing units arranged on one side of the image forming body can be increased, and further the capacities of the toner supply means can be well-balanced. However, when toner is moved from the toner container to the toner supply means, toner tends to be spilt, and height of the toner supply means is increased, so that it is difficult to downsize the image forming apparatus.

Another toner supply means is described below. The toner supply means has a toner cartridge composed as follows. The toner cartridge includes: a toner container having a main body, one end of which is open; a cap member engaging with an outer periphery on the open end side of the main body; and a toner conveyance screw portion, wherein the gear to be driven is arranged outside an end plate of the cap member, the shaft penetrates the end plate, the rotatable screw portion extends inside along the side wall of the main body, and the end portion of the screw portion is rotatably supported by the end plate of the main body. The toner cartridge is provided with a toner ejection port formed on the cap member on the conveyance end side of the toner conveyance screw portion or formed on the side wall. The toner ejection port is connected to the developing unit via a connection pipe in such a manner that the toner cartridge can be replaced from the developing unit. In the above apparatus, the screw member is rotated.

The above toner cartridge is disadvantageous in that the number of parts of the toner cartridge is increased and the cost is raised. Therefore, the following apparatus is disclosed in Japanese Patent Publication Open to Public Inspection Nos. 2881/1991, 477/1992, 1681/1992 and 266380/1990, and also disclosed in Japanese Patent Publication Nos. 60387/1988 and 6194/1993. A toner cartridge includes: a gear to be driven which is formed on the outer circumferential surface of the barrel wall; a spiral-shaped protrusion for feeding toner which is arranged on the inner circumferential surface. That is, the toner cartridge includes: a rotational container portion for conveying toner to one end; and a stationary cap portion rotatably engaged with one end of the container so that toner can be ejected from the toner ejection port having a sliding door provided on the side wall or the end plate. The toner ejection port of the stationary cap portion is connected with the developing unit via a connection pipe so that the toner cartridge can be replaced from the developing unit. The above apparatus is advantageous as follows. When toner is moved from the toner container, no toner is spilt. Since the toner cartridge is placed sideways, height of the toner cartridge is relatively small. Therefore, it is possible to downsize the image forming apparatus. Further, it is possible to increase the number of developing apparatus arranged on one side of the image forming body, and further the capacities of the toner cartridges can be well-balanced. However, even the above apparatus has the following disadvantages: it is complicated to disconnect the connection pipe from the developing unit in the case of maintenance; further, when the connection pipe is disconnected from the developing unit, toner tends to be spilt; furthermore, it is necessary to extend the connection pipe from the toner ejection port to the developing unit.

Since a quantity of toner ejected from the toner cartridge greatly fluctuates, in order to supply toner smoothly in accordance with the toner consumption, it is necessary to store a predetermined quantity of toner between the toner cartridge and the developing unit. In order to provide a sufficient space for installing the storage portion, it is necessary to separate the toner cartridge from the developing unit in the upward and downward direction. Due to the foregoing, it becomes difficult to downsize the image forming apparatus. In the case of a color image forming apparatus, a plurality of developing units are required. In this case, the number of the connection pipes is the same as the number of the developing units. Due to the foregoing, the cost is raised. The above problems are also caused in the case of the apparatus in which the toner cartridge requiring the screw member is used.

Concerning the connection pipe, the following 2 types are known. One is a connection pipe in which a spiral conveyance screw is inserted into a flexible tube, which will be referred to as a flexible type connection pipe, and the other is a connection pipe in which a spiral screw is inserted into a solid pipe, which will be referred to as a pipe type connection pipe. The connection pipe is connected to a toner receiving port of the developing unit, or alternatively, in the case of a detachable type developing unit, the connection pipe is detachably connected to the toner receiving port by a connection means. Since it is necessary to electrically charge toner by agitating it with an agitating screw, the toner receiving port is provided in an upper portion of the agitating screw in such a manner that the toner receiving port penetrates the side wall of the developing apparatus. In this connection, in order to convey a predetermined quantity of toner by the flexible connection pipe, the inner diameter of the flexible tube is increased, so that the outer diameter is increased. When this flexible connection pipe is assembled to the image forming apparatus, it is difficult to bend the flexible pipe by a small radius of curvature, because the spiral conveyance screw inserted into the flexible connection pipe functions as a coil spring.

Accordingly, when the flexible connection pipe is bent by a small radius of curvature, the elastic deformation of the conveyance screw is increased. In general, the spiral conveyance screw is made of metal. Therefore, in order to prevent the deterioration of the bent portion of the conveyance screw, it is necessary to reduce the number of revolutions per unit hour of the spiral conveyance screw, or alteratively it is necessary to increase the radius of curvature of the bent portion. However, when the number of revolutions per unit hour of the spiral conveyance screw is reduced, a quantity of conveyed toner is lowered, and as a result, the number of image formation per unit hour is lowered. On the other hand, when the radius of curvature is reduced, the dimensions of the image forming apparatus are increased. Further, when the radius of curvature is reduced, since the flexible tube is generally made of resin, the flexible tube is damaged by the metallic conveyance screw at the bent portion. In order to assemble the pipe type connection pipe into the image forming apparatus, the connection pipe is extended in the apparatus. Therefore, end portions of solid pipe members must be connected with each other so that the conveyance direction can be changed. However, since the rotational shaft of the conveyance screw is supported by the pipe end, it is impossible to connect the pipe ends. Accordingly, the pipe connection is conducted in such a manner that a small hole, which functions as a toner current path, is formed at a position close to the pipe end so that the connection can be made through the hole. In this case, a joint portion where two pipes are joined to each other becomes a bulky node, so that the pipe extension is limited. Due to the foregoing, it is difficult to downsize the image forming apparatus. Especially, in the case of a color image forming apparatus, the connection pipes must be extended with respect to a plurality of developing units. Therefore, it is difficult to downsize the color image forming apparatus.

SUMMARY OF THE INVENTION

An object of the present invention is to provide a compact and inexpensive image forming apparatus in which the toner supply source and the developing unit can be easily replaced and maintained.

An embodiment of the invention is to provide an image forming apparatus comprising: a plurality of toner storage means for storing toner; a developing unit composed of a plurality of developing devices; and a plurality of toner conveyance means for conveying toner from the toner storage means to the developing unit, wherein a through-hole is formed in the developing unit, and an upper portion of the through-hole is connected with the toner conveyance means in such a manner that the upper opening of the through-hole is opposed to an ejection port of the toner conveyance means, so that toner drops from the toner conveyance means into this through-hole and is guided to each developing device.

Accordingly, it is possible to convey toner from the toner storage portion to the developing device without extending the connection pipe in the image forming apparatus. Therefore, it is possible to provide a compact and inexpensive image forming apparatus.

Another embodiment of the invention is composed as follows. In an image forming apparatus in which a latent image is formed on the surface of an image forming body and a toner image is developed by a developing device, a toner conveyance means for conveying toner from a toner supply source to a developing device is arranged on a carriage for holding the toner supply source and the developing device; the carriage holds the toner supply source and the developing device so that the developing device can be arranged below the toner supply source; and the toner conveyance means conveys toner approximately horizontally and then drops toner into a toner receiving port of the developing device. Further, there are provided a plurality sets of toner supply sources, developing devices and toner conveyance means, and toner dropping positions of the plurality of toner conveyance means are close to each other.

As described above in the embodiment, the image forming apparatus of the present invention has the following advantages. Since the carriage for holding the toner supply source and the developing device is provided with a toner conveyance means for conveying toner from the toner supply device to the developing device, it is not necessary to provide an independent toner conveyance means between the toner supply source and the developing device different from the carriage described above. Accordingly, it is possible to provide a compact image forming apparatus at a relatively low cost, and further it is easy to replace and maintain the toner supply source. In the case where the carriage holds the toner supply source and the developing device in such a manner that the developing device is disposed below the toner supply source, the width of the image forming apparatus is not extended by the toner supply source, so that the dimensions of the apparatus are not increased. In the case where the toner conveyance means conveys toner approximately horizontally and drops it into the toner receiving hole of the developing device, the height of the toner conveyance means is very small, so that the overall image forming apparatus is made compact. In this case, when the developing device is attached to and detached from the carriage, it is not necessary to connect and disconnect the connection pipe. In the case of a color image forming apparatus in which a plurality of sets of toner supply sources, developing devices and toner conveyance means are provided and the toner dropping positions of the plurality of toner conveyance means are disposed close to each other, it is possible to arrange the plurality of toner supply sources transversely and it is also possible to close the toner dropping ports to the plurality of developing devices so as to prevent toner from spilling over in the case of replacing the developing devices. In this case, it is possible to close the ports by one sliding door. For this reason, the image forming apparatus can be made compact and further the cost can be reduced. Furthermore, the plurality of toner supply sources and developing devices can be easily replaced and maintained.

BRIEF DESCRIPTION OF THE DRAWINGS

FIG. 8(A) is an upper face view of the color unit of another example.

FIG. 8(B) is an upper face view of the color unit of another example.

FIG. 8(C) is a cross-sectional view of the color unit of another example.

DETAILED DESCRIPTION OF THE PREFERRED EMBODIMENT

With reference to an example shown in the accompanying drawings, the present invention will be explained in detail.

Figure 1:
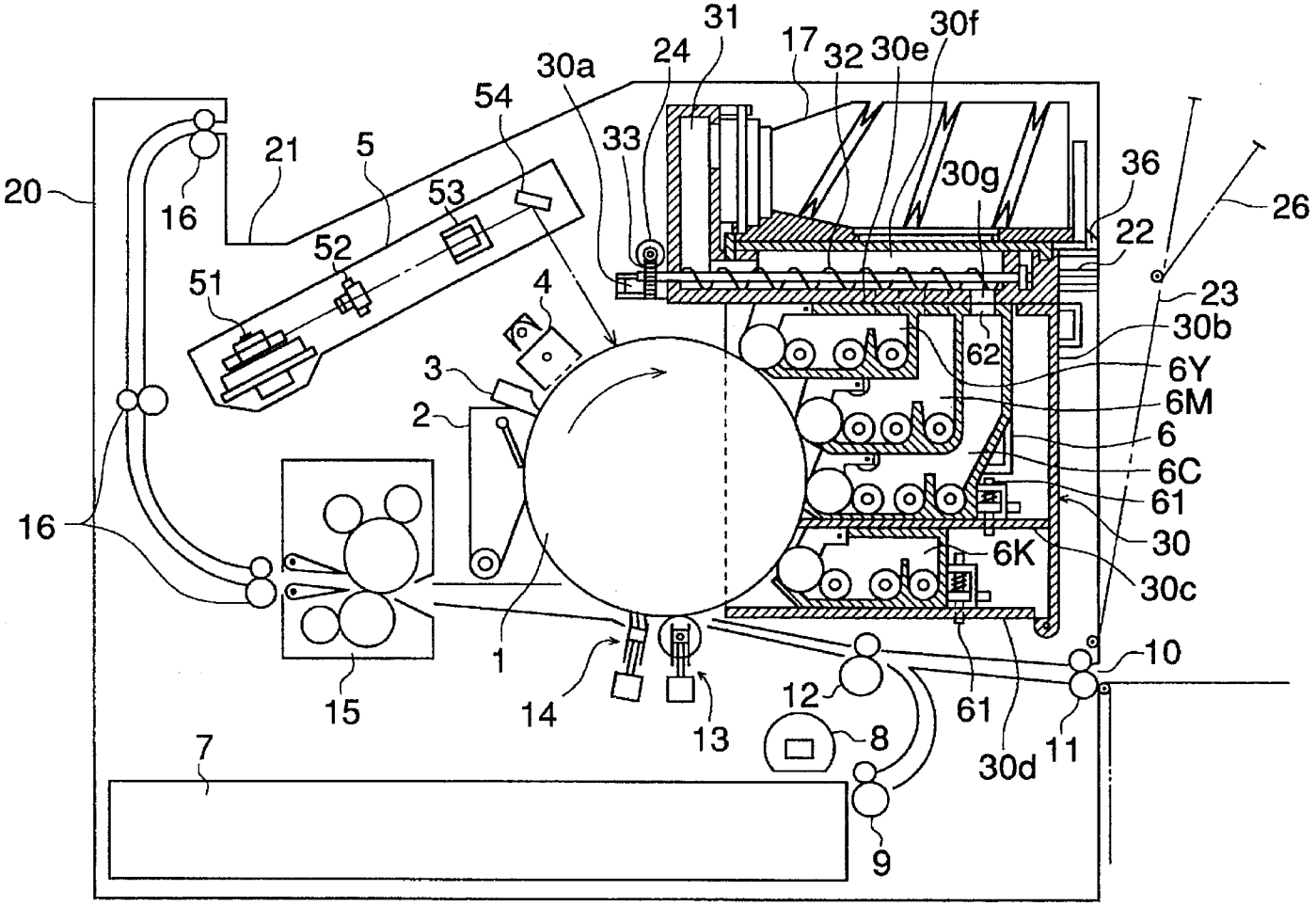
FIG. 1 is an overall cross-sectional view showing an example of the image forming apparatus of the present invention.
Figure 2:
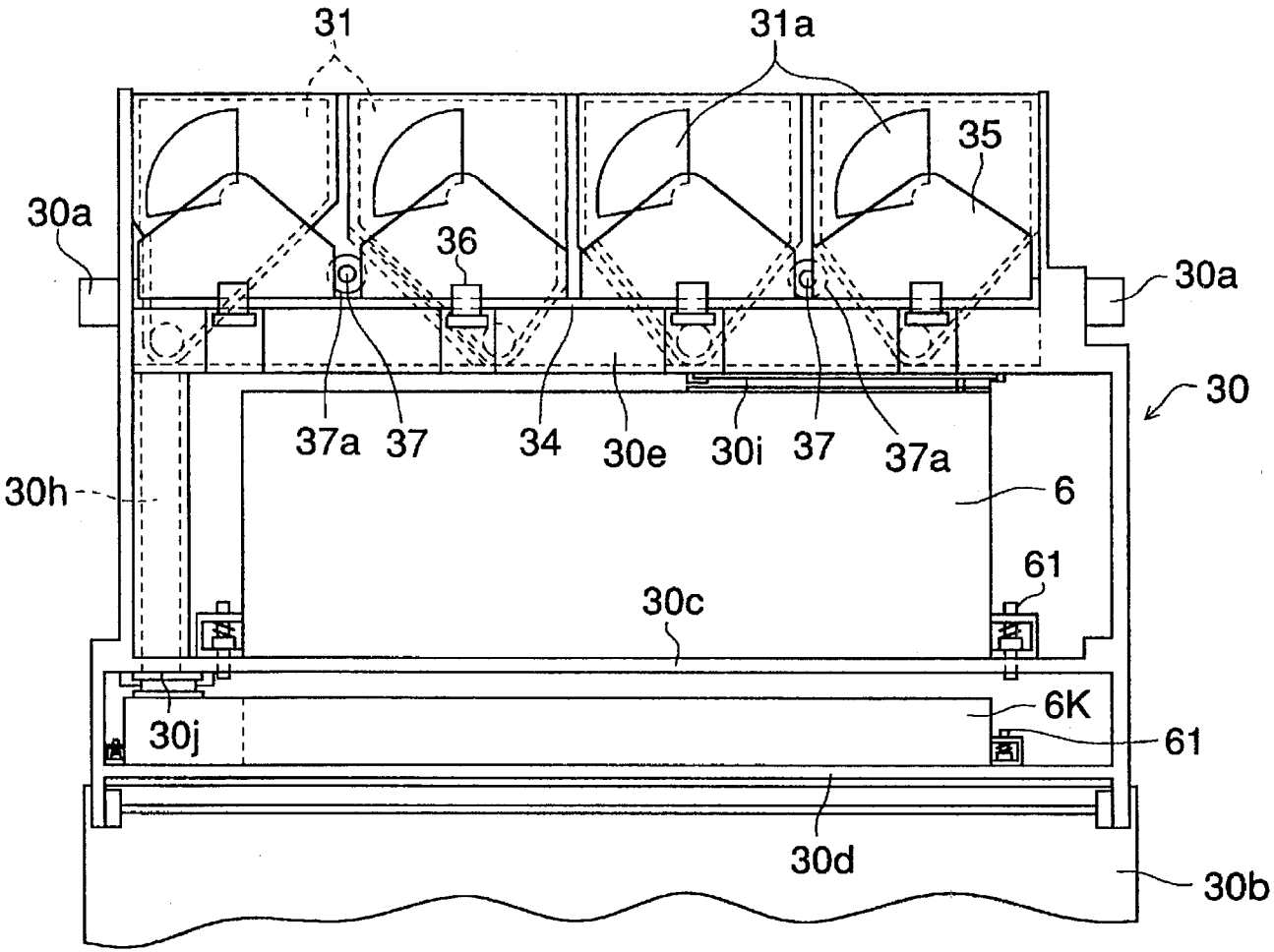
FIG. 2 is a side view of the developing unit frame, wherein the view is taken from the right in FIG. 1.
Figure 3:
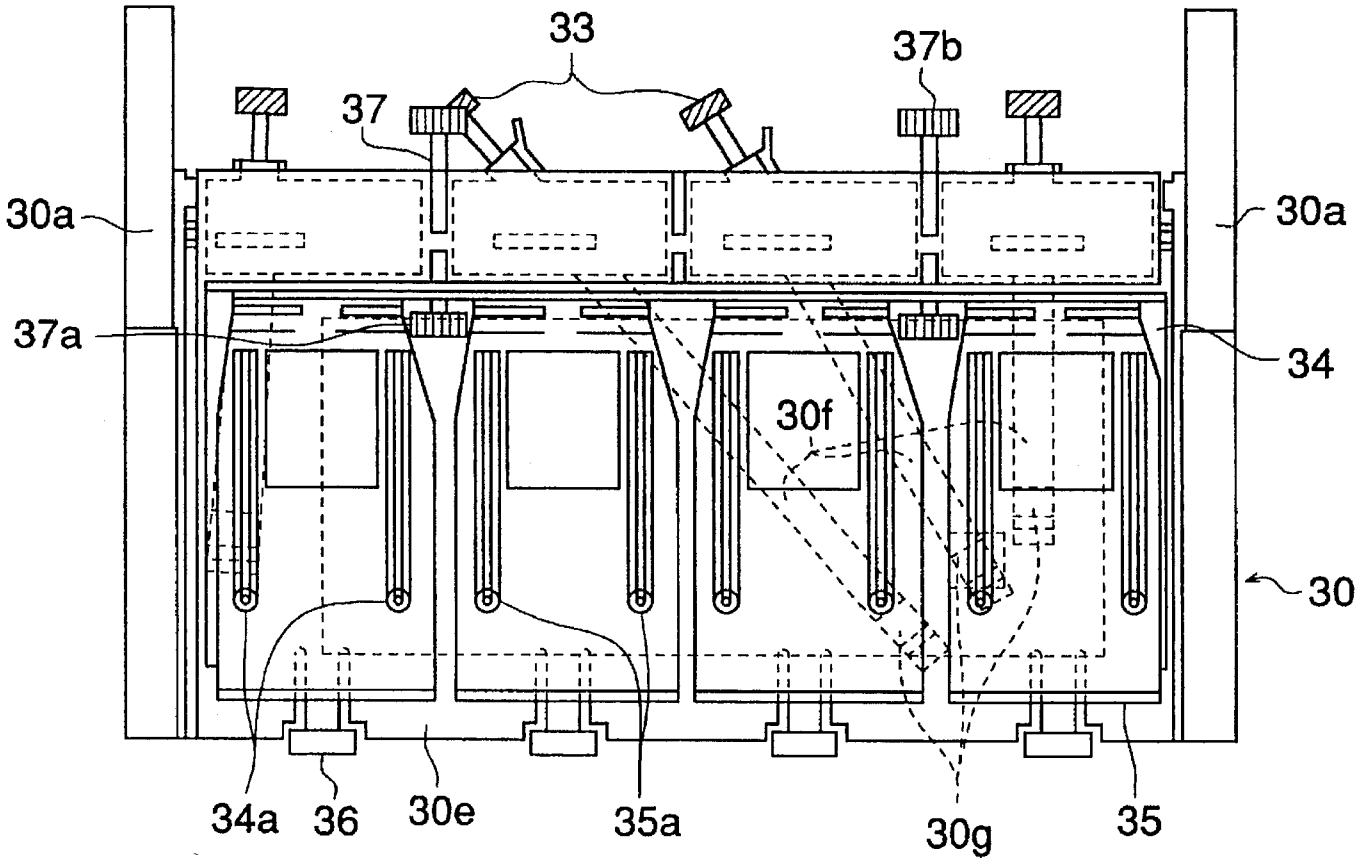
FIG. 3 is a plan view of the developing unit frame, wherein the view is taken from the upside in FIG. 1.
Figure 4:
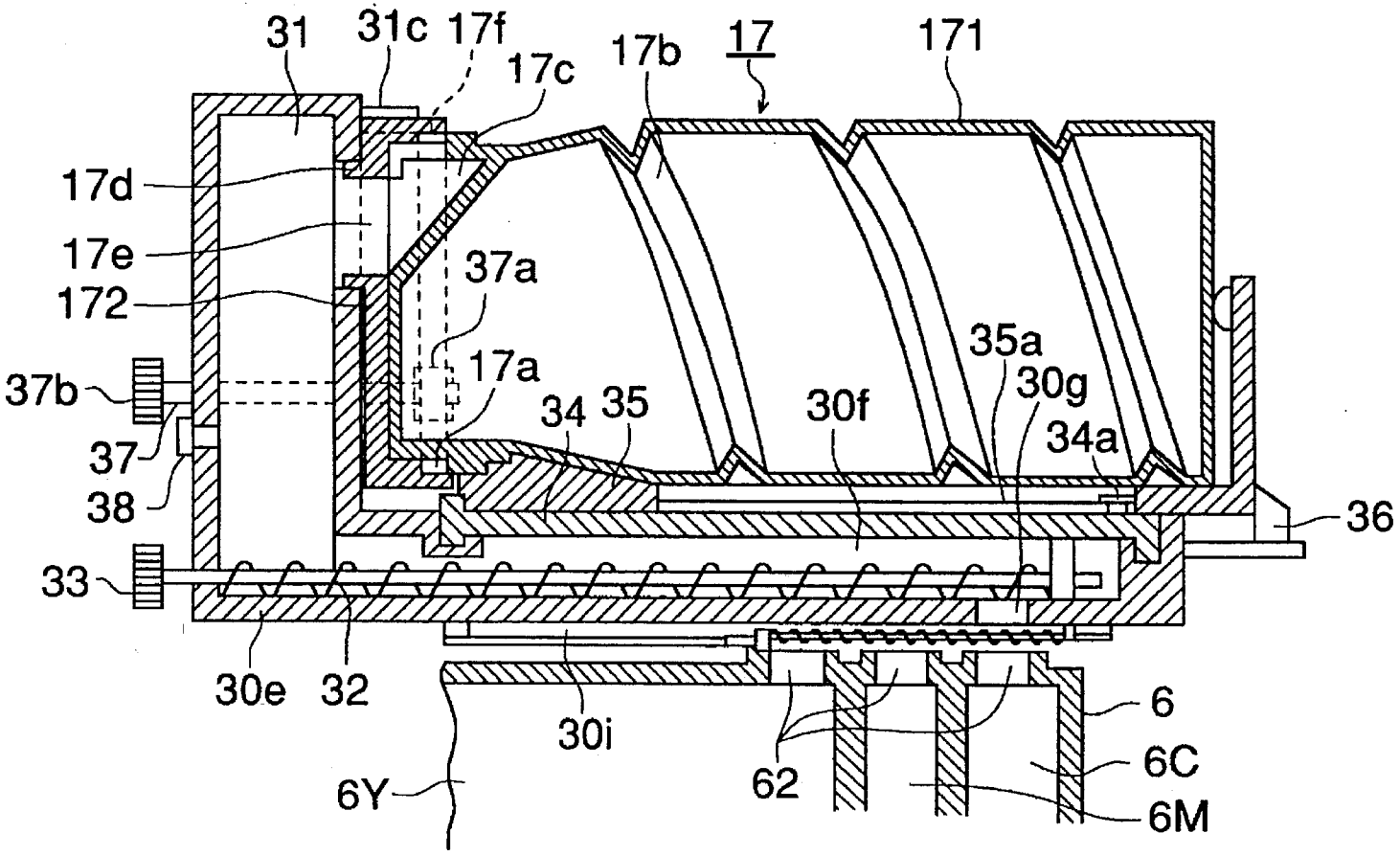
FIG. 4 is a partially enlarged view showing the toner conveyance means of the developing unit frame shown in FIG. 1.
Figure 5:
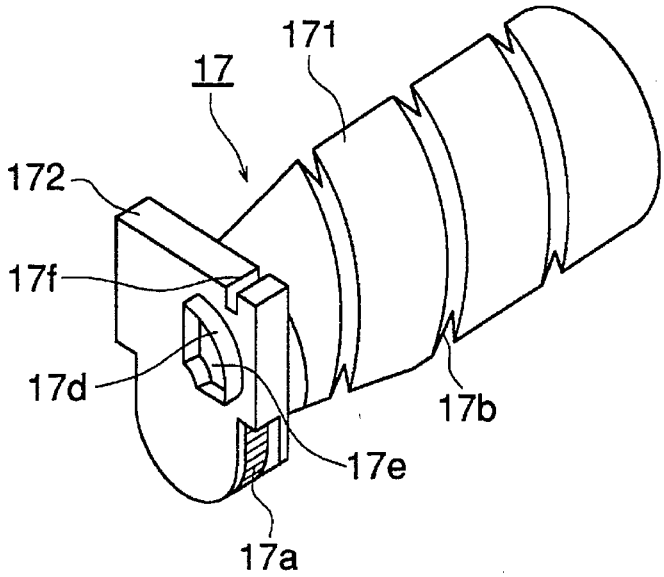
FIG. 5 is a perspective view of the toner cartridge.
Figure 6:
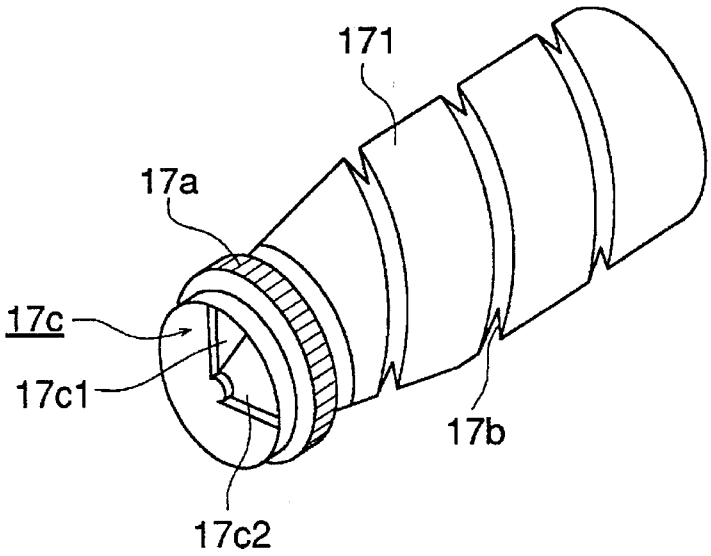
FIG. 6 is a perspective view of the rotational container of the toner cartridge.

FIG. 1 is an overall cross-sectional view showing an example of the image forming apparatus of the present invention. FIG. 2 is a side view of the developing unit frame, wherein the view is taken from the right in FIG. 1. FIG. 3 is a plan view of the developing unit frame, wherein the view is taken from the upside in FIG. 1. FIG. 4 is a partially enlarged view showing the toner conveyance means of the developing unit frame shown in FIG. 1. FIG. 5 is a perspective view of the toner cartridge. FIG. 6 is a perspective view of the rotational container of the toner cartridge.

FIG. 1 is a view showing an example of the color image forming apparatus. In FIG. 1, there is provided a drum-shaped image forming body 1, which is composed in such a manner that an OPC photoreceptor is provided on a conductive drum base body. In this case, the drum base body is grounded and rotated clockwise, and image formation is conducted as follows.

Residual toner on the circumferential surface of the rotational image forming body 1 is removed by the cleaning unit 2. Next, in order to erase the hysteresis of the image forming body 1, PCL 3 having a light emitting diode exposes the image forming body 1 with light, so that the circumferential surface of the image forming body 1 is electrically discharged. Then, the scorotron charger 4 uniformly charges the circumferential surface of the image forming body 1. Image exposure of the separation color of yellow (Y) is conducted in accordance with an image signal on the uniformly charged surface by the image exposure means 5 including a laser diode not shown, polygonal mirror 51, fθ lens 52, cylindrical lens 53, and reflection mirror 54. By the image exposure described above, an electrostatic image of Y composed of dots are formed. Then, a Y-toner image is formed in the following manner. The developing device 6Y accommodating Y-toner conducts developing the electrostatic latent image when toner particles charged to the same polarity as that of the image forming body 1 are scattered from a developer layer formed on the developing roller which is not contacted with the image forming body 1. In this way, the electrostatic latent image is developed by means of reversal development.

A portion of the surface of the image forming body 1 on which the Y-toner image is formed passes through other units which are not activated, such as developing devices 6M, 6C, 6K, transfer means 13, separation means 14, cleaning unit 2 and PCL 3. When this portion of the surface of the image forming body 1 comes to the position of the charger 4, it is uniformly charged again. The image exposure means 5 conducts image exposure on the electrically charged surface so that an electrostatic latent image of magenta (M) can be formed. The thus formed magenta image is developed into an M toner image by the developing device 6M in which M-toner is used. Due to the foregoing, toner image of two colors of Y and M are formed on the surface of the image forming body 1. At this time, the developing device 6Y has already been put into a condition in which the device is not activated.

The portion of the surface of the image forming body 1 on which the 2 color image is formed is uniformly charged by the charger 4 in the same manner as described above. After that, an electrostatic latent image of cyan (C) is formed by the image forming means 5. The electrostatic latent image of cyan (C) is developed into a C-toner image by the developing device 6C in which developer of cyan toner is used. Due to the foregoing, 3 color toner image of Y, M and C is formed on the surface of the image forming body 1. The portion of the surface on which the 3 color toner image is formed is uniformly charged in the same manner as that described before. Then image exposure light is incident onto the portion, so that an electrostatic latent image of black (K) is formed. The thus formed electrostatic latent image is developed into a toner image of K by the developing unit 6. In this way, a color image composed of 4 color toner image of Y to K is formed.

For the purpose of forming a clear color image, it is preferable that 2-component developer is used in the developing devices 6Y to 6K. However, it should be noted that the present invention is not limited to the 2-component developer, but 1-component may be used.

The thus formed color toner image is transferred onto a recording sheet by the transfer unit 13. In this case, the recording sheet is sent out from the sheet feed cassette. Then the recording sheet is conveyed by the frictional conveyance roller 8 and the pinching conveyance roller 9. Alternatively, the recording sheet is sent into the apparatus from the hand-feed port 10 and conveyed by the feed roller 11. After that, the recording sheet is conveyed by the timing roller 12 in timed relation to the formation of the image on the image forming body 1. Transfer means 13 is composed of an electrode roller upon which a voltage, the polarity of which is reverse to that of the electrically charged toner, and the electrode roller of the transfer means 13 is displaced from an inactive position separate from the image forming body 1, to a position where the electrode roller comes into pressure contact with the image forming body 1. Next, the recording sheet is separated from the image forming body 1 by the separation means 14 composed of an electrically conductive brush which is displaced from an inactive position to an active position where the conductive brush is pressed against the image forming body 1. After that, the color image is fixed by the fixing unit 15. Then the recording sheet is ejected by the pinching conveyance roller 16 onto the recording sheet tray 21 arranged in an upper portion of the color image forming apparatus 20.

On the other hand, the surface of the image forming body 1 onto which the color image has been transferred is cleaned by the cleaning unit 2 that has been put into the operative condition. Then the surface of the image forming body 1 is electrically discharged by PCL 3. In this way, the image forming body 1 is prepared for the next image forming operation. In this connection, the inoperative condition is defined as a condition in which a unit is separated from the image forming body, and the operative condition is defined as a condition in which a unit comes into contact with the image forming body. After a recording sheet has passed through the surface of the image forming body, the transfer means 13 and the separation means 14 are separated from the circumferential surface of the image forming body 1, so that they are put into the inoperative condition.

In order to downsize the color image forming apparatus for the reduction of the cost, the color image forming apparatus is composed as follows. Each of the developing device and the toner supply means is formed into one separate unit capable of being easily attached to and detached from the color image forming apparatus 20. Specifically, the toner cartridge 17 is used for the toner supply means so that toner can not be spilt. The toner cartridge 17 and the developing device are detachably attached to the developing unit frame (carriage) 30 having a conveyance means for conveying toner from the toner cartridge to the developing device, and the developing unit frame 30 can be easily attached to the apparatus body 20 via the guide rails 22 provided in the apparatus body 20. There is provided a toner hopper 31 in the toner conveyance means of the developing unit frame 30 so that toner can be smoothly supplied from the toner cartridge 17 to the developing device. The developing devices 6Y, 6M, 6C, the quantities of toner consumption of which are relatively small, are integrated into one color unit 6, and the developing device 6K, the quantity of toner consumption of which is relatively large, is independently formed into one unit.

With reference to FIGS. 2 to 6, the structure of the present invention in which the developing unit frame 30 is used will be explained below.

The developing unit frame 30 is attached to the apparatus body 20 in such a manner that sliding arms 30*a* provided on both side walls of the developing unit frame 30 are engaged with the guide rails 22 of the apparatus body 20, and the developing unit frame 30 is inserted into the apparatus body 20. When the developing unit frame 30 is drawn out from the apparatus body 20, it can be detached from the apparatus. When a front door 30*b* of the developing unit frame 30 is opened clockwise around a hinge arranged at a lower position of the front door 30*b* in FIG. 1, the color unit 6 and the developing device 6K can be attached to and detached from the color unit shelf 30*c* and the K developing unit shelf 30*d*. When the color unit 6 and the developing device 6K are attached to the apparatus body, positioning pins 61 respectively provided in the units are engaged with engaging holes formed in the color unit shelf 30*c* and the K developing unit shelf 30*d*. When the color unit 6 and the developing device 6K are detached from the apparatus body, the positioning pins 61 are pulled out from the engaging holes, resisting a spring force. In this way, the color unit 6 and the developing device 6K can be drawn out from the apparatus body. The developing devices 6Y to 6K are composed in such a manner that the developing devices 6Y to 6K are elastically displaced together with the toner layer regulating member for regulating the thickness of a toner layer on the developing roller so that a clearance between the developing roller and the image forming body 1 can be maintained at a value appropriate for image formation.

A ceiling wall of the developing unit frame 30, the color unit 6 is arranged under the ceiling wall, is used as a receiving floor 30*e* of the toner cartridge 17. On the receiving floor 30*e*, there are provided a toner hopper 31 for storing toner ejected from the toner cartridge 17, a toner passage 30*f* for guiding toner from a lower portion of the toner hopper 31 to an upper portion of the toner receiving port 62 of the developing unit, and a dropping hole 30*g* for dropping toner into the toner receiving port 62 at an end portion of the toner passage 30*f*. In the toner passage 30*f*, there is provided a toner conveyance screw 32, and a gear 33 to be driven, which is attached to the toner conveyance screw 32, is protruded from an outer wall of the hopper 31. This gear 33 to be driven, which is attached to the toner conveyance screw 32, is meshed with a drive gear 24 provided in the apparatus body 20 under the condition that the developing unit frame 30 is arranged at a predetermined position. When this drive gear 24 is operated, the toner conveyance screw 32 conveys the toner from the toner hopper 31 into the dropping hole 30*g*.

As illustrated in FIGS. 4 to 6, the toner cartridge 17 is composed as follows. There is provided a gear 17*a* to be driven on the outer circumference of the drum wall, and also there is provided a spiral protrusion 17*b* on the inner circumference of the drum wall. There is provided a toner scooping and ejecting section 17*c* on an end plate of the rotary container 171 disposed in the toner conveyance direction in which toner is conveyed by the spiral protrusion 17*b*. There is provided a toner ejecting port 17*e* on the end plate of the rotary container 171 having the toner scooping and ejecting section 17*c*. The scooping and ejecting section 17*c* of the rotary container 171 includes: an approximately right-angled triangular scooping opening which is open to a face in the radial direction approximately perpendicular to the end plate; and an inclined face 17*c* for guiding toner from the opening 17*c* to the outside of the end plate.

With reference to FIG. 4, attachment of the toner cartridge 17 to the receiving floor 30*e* will be described as follows.

The toner cartridge 17 is disposed on the receiving floor 30*e*. On the receiving floor 30*e*, there is provided a cover member 34 for covering the toner passage 30*f* in such a manner that the cover member 34 does not slip. Above the cover member 34, there is provided a slide mount 35 in such a manner that the slide mount 35 can be moved on the cover member by a distance corresponding to the length of a slide groove 35*a*, wherein the slide groove 35*a* is formed in the slide mount 35 and engaged with an engaging pin 34*a* implanted in the cover member 34. Under the condition that the toner cartridge 17 is attached to the apparatus as illustrated in FIGS. 1 and 4, the slide mount 35 is engaged by an engaging spring 36 provided on the receiving floor 30*e*. When the toner cartridge 17 is detached from the apparatus, the engaging spring 36 is compressed, so that the slide mount 35 is released, and the slide mount 35 is slid to the right and the toner cartridge 17 is picked upward.

When the toner cartridge 17 is attached to the apparatus, the operation is conducted as follows. The toner cartridge 17 is set on the slide mount 35, which has slid to the right, under the condition that an upper surface of the stationary cap portion 172 is disposed upward. Then the slide mount 35 is slid to the left. Then, a stopper bar 31*c* provided in an upper portion of the front wall of the hopper 31 is engaged with a stopper groove 17*f* of the stationary cap portion 172. As illustrated in FIGS. 2 and 4, a drive gear 37*a* is mounted on the gear shaft 37 rotatably held by the hopper supporting portion, wherein the drive gear 37*a* is arranged at an end of the gear shaft 37 on the slide mount 35 side. The drive gear 37*a* is meshed with a gear 17*a* to be driven provided on the outer circumference of the rotary container 171. Further, a protruding edge 17*d* of the toner ejecting port 17*e* of the toner cartridge 17 is engaged with the toner receiving opening 31*a* of the hopper 31 shown in FIG. 2, and the engaging spring 36 is engaged with the right end of the slide mount 35.

It is possible to conduct the attachment and detachment of the toner cartridge 17 under the condition that the developing unit frame 30 is pulled out from the apparatus body 20, and also it is possible to conduct the attachment and detachment of the toner cartridge 17 under the condition that the developing unit frame 30 is attached to the apparatus body 20. When the attachment and detachment of the toner cartridge 17 is conducted under the condition that the developing unit frame 30 is attached to the apparatus body 20, even if the side wall door 23 of the apparatus body 20 is closed, the attachment and detachment of the toner cartridge 17 can be conducted when the partial door 26 provided on the side wall door 23 is opened. When the developing unit frame 30 is attached into the apparatus body 20, the gear **37*b* to be driven, which is mounted on the protruding end of the gear shaft 37, is meshed with a drive gear not shown in the drawing. Due to the foregoing, the rotary container 171 of the toner cartridge 17** is rotated.

When the rotary container 171 of the toner cartridge 17 is rotated as described above, the toner accommodated in the rotary container 171 is conveyed to the toner scooping and ejecting section **17*c* by the spiral protrusion 17*b*. In the apparatus illustrated in the drawing, the toner is ejected by the toner scooping and ejecting section 17*c* from the toner ejecting port 17*e* of the stationary cap portion 172 into the toner hopper 31, wherein the toner ejection is conducted once per one revolution of the rotary container 171. In this case, the toner cartridge 17 is rotated in accordance with the detection information of a toner sensor 38 provided in the toner hopper 31 by the control of a control unit (not shown) so that the toner level in the toner hopper 31 can be maintained at a predetermined value. In this connection, a plurality of toner scooping and ejecting sections 17*c* may be provided, for example, 2 toner scooping and ejecting sections 17*c* may be provided, the phases of which are different by 180°, and 3 toner scooping and ejecting sections 17*c* may be provided, the phases of which are different by 120°. Due to the above structure, toner can be ejected into the toner hopper 31 at 2 or 3 times by one revolution of the toner cartridge 17**.

As described above, when the toner conveyance screw 32 is rotated by the drive gear 24, toner is conveyed in the toner passage **30*f* on the receiving floor 30*e* and dropped from the dropping hole 30*g* into the toner receiving port 62 of the developing unit. Rotation of this toner conveyance screw 32 is controlled by the control unit in accordance with the information sent from a toner concentration sensor provided in the developing apparatus or in accordance with the information sent from a toner image density sensor, so that the concentration of toner in the developer or the density of the toner image formed on the image forming body 1** can be maintained to be constant. In the exemplary color image forming apparatus shown in the drawing, and also in the monochromatic image forming apparatus of black, it is preferable to control in accordance with the information sent from the toner concentration sensor provided in the developing apparatus.

In the case where one-component developer is used, a toner sensor to detect the toner level is used instead of the toner concentration sensor.

As illustrated in FIGS. 2 and 3, the developing unit frame 30 of the color image forming apparatus shown in FIG. 1 is composed as follows. There are provided 4 hoppers 31 on the receiving floor **30*e*. There is provided a cover member 34 on the receiving floor 30*e* on the side at which the toner passage 30*f* is arranged. On the cover member 34, there are provided 4 slide mounts 35, so that 4 toner cartridges 17 can be attached to them. On the ceiling plate of the color unit 6, there are provided toner receiving ports 62 for receiving toner supplied to the developing devices 6Y, 6M, 6C. Accordingly, toner can be directly dropped from the toner dropping hole 30*g* formed in the toner passage 30*f* into the toner receiving port 62 of the developing unit. Since the developing device 6K is more frequently used than other color developing units so that a quantity of toner consumption is large and the life is short, it is not appropriate to integrate it with the color unit because the weigh is excessively increased. It is appropriate to provide the developing unit K separately from the color unit. When the developing device 6K is provided separately from the color unit, it is impossible to directly drop toner from the dropping hole 30*g* formed in the toner passage 30*f* on the receiving floor 30*e* into the developing device 6K. Therefore, the following measure is taken. Width of the developer storage chamber of the developing device 6K is extended to be wider than the width of the color unit 6, and the toner receiving hole 62 is formed on the ceiling plate in the extended portion. In the developing unit frame 30, there is formed a pipe 30*h* which is connected with the dropping hole 30*g* in the toner passage 30*f* on the receiving floor 30*e*, and this pipe 30*h* penetrates the color unit shelf 30*c* on the side wall of the developing unit 30 and is open at a position immediately above the toner receiving port 62 of the developing device 6K. Due the foregoing guide pipe 30*h*, toner can be smoothly supplied to the developing device 6K in the same manner as the developing devices 6Y, 6M, 6C provided in the color unit 6**.

As illustrated in FIG. 2 or 4, on the lower surface of the receiving floor **30*e* of the developing unit frame 30, there is provided a slide door 30*i* for opening and closing the hole 30*g* through which toner is dropped into the developing unit of the color unit 6, and on the lower surface of the color unit shelf 30*c*, there is provided a slide door 30*j* for opening and closing the guide pipe 30*h* through which toner is dropped into the developing device 6K. In this case, the slide doors 30*i*, 30*j* are pushed by springs in the closing direction. The slide door 30*i* closes the three dropping holes 30*g* being pushed by the spring when the color unit is picked up from the developing unit frame 6. Accordingly, toner is prevented from spilling over. When the color unit 6 is attached to the developing unit frame 30, toner can be smoothly supplied because the three dropping holes 30*g* are open while the slide door 30*i* is pushed by the color unit 6. In the same manner, the slide door 30*j* opens and closes the opening of the guide pipe 30*h* in accordance with the attachment and detachment of the developing device 6**K, so that toner can be smoothly supplied while toner is prevented from spilling over.

Next, with reference to FIGS. 7(A) and 7(B), the structure of the color unit 6 will be explained as follows. As described before, the color unit 6 includes the developing units 6 (Y, M, C). Each developing unit includes: an agitating screw 61 (Y, M, C); a supply paddle 62 (Y, M, C); a developing sleeve 63 (Y, M, C); and a developer layer regulating member 64 (Y, M, C). The color unit 6 is arranged at a predetermined position with respect to the drum-shaped image forming body 1 of the present invention, and two-component reversal development is conducted under a non-contact condition.

The color unit 6 includes three developing unit bottom plates 65 (Y, M, C) which are the bulkhead related to the present invention. One developing unit is mounted on each developing unit bottom plate 65 (Y, M, C), and three developing units and bottom plates are stacked on each other and integrated into one body. Above the developing unit bottom plate 65 Y disposed at the uppermost position, there is provided a developing unit ceiling plate 66. In this way, the developing unit is composed. In this case, the developing unit bottom plates 65 (Y, M, C) are adhered to each other, and also the developing unit ceiling plate 66 is attached by means of adhesion. Specifically, on the lowermost developing unit bottom plate 65, there are provided a pair of agitating screws 61C and a supply paddle 62C, and further the developing sleeve 63C and the layer thickness regulating member 64C are held on the lowermost developing unit bottom plate 65 in such a manner that they can be displaced. This developing unit is closed by the ceiling plate. However, when another developing unit bottom plate 65 Y or 65 M is stacked on the lowermost developing unit bottom plate 65 C, another developing unit bottom plate 65 Y or 65 M functions as a ceiling plate of the lowermost developing unit bottom plate 65. In the manner described above, the developing units of the color unit 6 are successively stacked on each other. The developing unit ceiling plate 66 is fixed onto the uppermost developing unit bottom plate 65, so that the developing unit is closed. As described above, in the color unit 6, the three developing units 6 (Y, M, C) are separate from each other by the bulkheads of the developing unit bottom plates 65. A toner image is formed on the drum-shaped image forming body 1 by the three developing units 6 (Y, M, C).

Unlike the conventional developing unit, the thus composed color unit 6 is advantageous in that the individual developing devices are not displaced with respect to the image carrier, and the agitating chambers (Y, M, C) are not displaced from each other.

Rotary side plates 68 shown by dot-lines in the drawing hold both end portions of the rotational shaft of the developing sleeve. The rotary side plates 68 are rotatably held by the color unit 6 through rotary pins 69. The rotary side plates 68 are fixed to both ends of the layer thickness regulating member 64 which is a means for regulating the layer thickness. Accordingly, when the rotary side plates 68 are rotated around the rotary pins 69, the rotational shaft of the developing sleeve is displaced with respect to the image carrier. In this embodiment, both the developing sleeve and the layer thickness regulating member 64 are held or fixed to the rotary side plates 68. Therefore, even if the rotational shaft of the developing sleeve is displaced, a clearance between the developing sleeve and the layer thickness regulating member 68 can be maintained at a value appropriate for the formation of a thin layer suitable for two-component non-contact development. Since the rotational side plates 68 are fixed to both ends of the layer thickness regulating member 64, the rigidity of which is high, the rotational shaft of the development sleeve is not twisted.

A supply path block 80 is a block member having a supply passage of the present invention. Supply paths 81Y, 81M, 81C are formed in such a manner that they penetrate the supply path block 80. Each supply path 81Y, 81M, 81C is provided with a receiving port 62. The receiving port 62 is disposed in an upper portion of the developing unit. In this case, the dropping hole 30*g* is opposed to the dropping hole 30*f* so that the ejected toner can not spill over. Toner is ejected from the toner cartridge 17 into the toner hopper 31. Then the toner is sent to the dropping hole 30*g* through the toner path 30*f*. Then the toner passes through the supply path 81Y, 81M, 81C and reaches the agitating screw 61 (Y, M, C) of each developing device 6 (Y, M, C). In the supply path 81Y, there is provided a supply path block 80 so that the toner flowing in the supply paths 81M, 81C can not enter the supply path 81Y. In the same manner, in the supply path 81M or 81C, there is provided a supply path block 80 so that the toner flowing in other paths can not enter the supply path 81M or 81C. As described before, the toner cartridge 17, toner hopper 31, toner path 30*f* and dropping hole 30*g* are provided for each color toner. Yellow toner is conveyed from the toner cartridge 17 to the dropping hole 30*g* without being mixed with toners of other colors. Then the toner drops from the dropping hole 30*g* into the supply path 81Y and reaches the agitating screw 61 (Y, M, C).

The supply path 81M penetrates the developing device bottom plate 65Y of the developing device 6Y. This supply path 81M supplies toner to the agitating screw 61M through the developing device bottom plate 65Y. The supply path 81C penetrates the developing device bottom plate 65M of the developing device 6M. This supply path 81C supplies toner to the agitating screw 61C through the developing device bottom plate 65M.

Figure 7A:
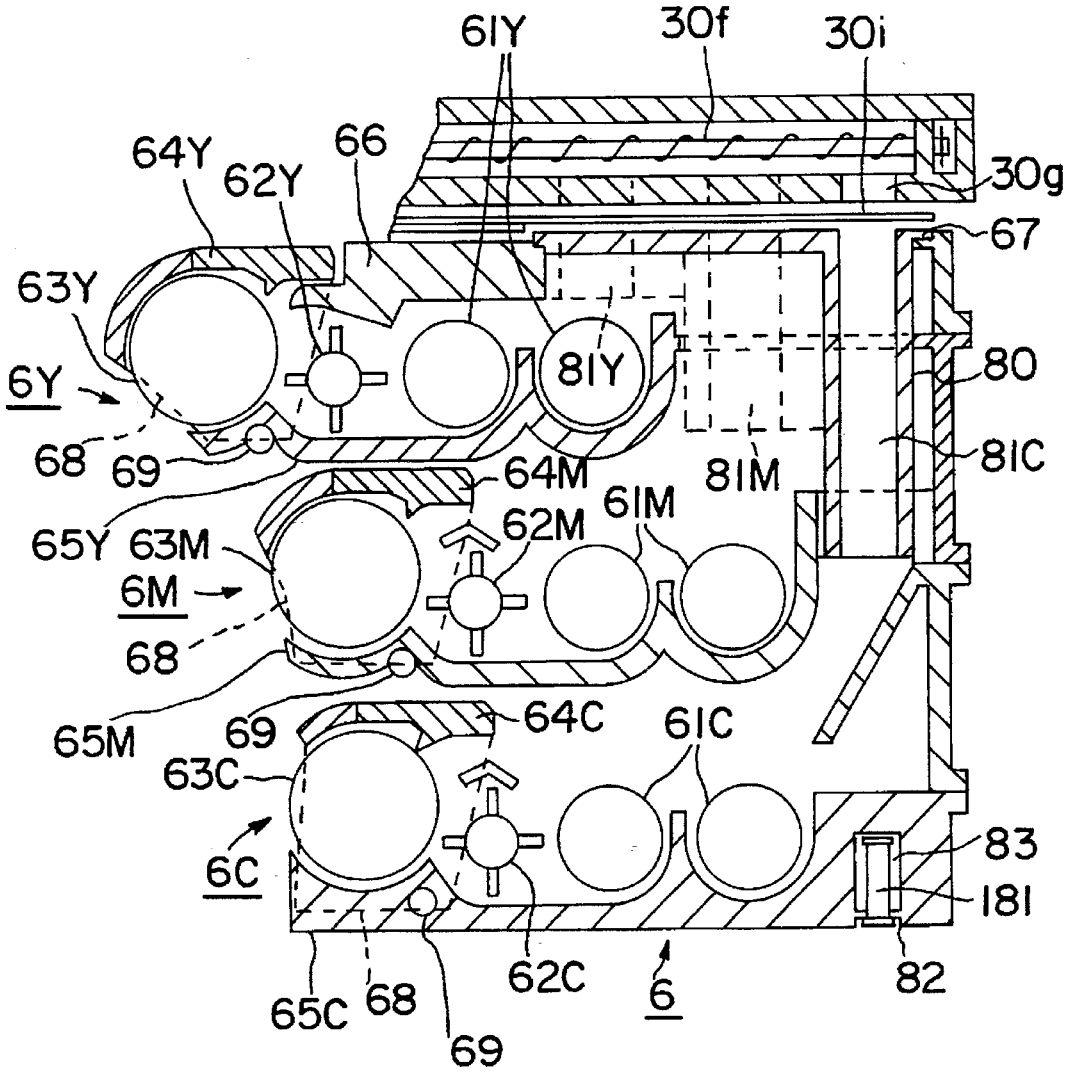
FIG. 7(A) is an arrangement view of the color unit.
Figure 7B:
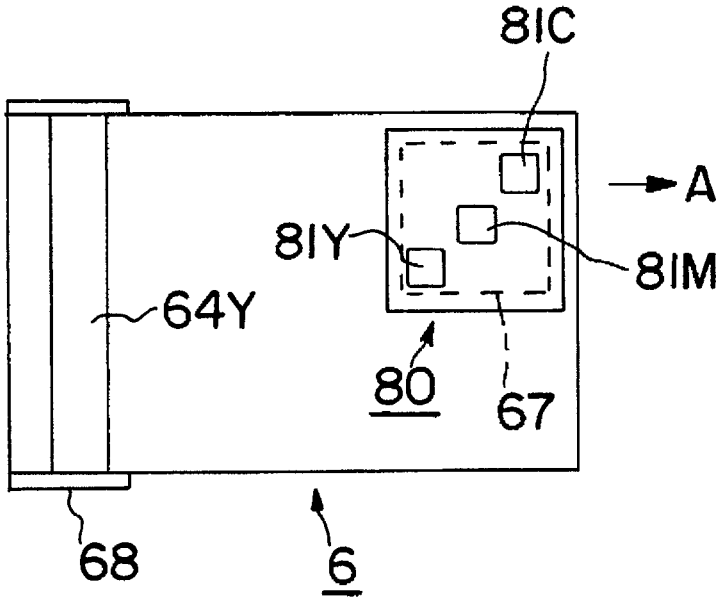
FIG. 7(B) is an upper face view of the color unit.

FIG. 7(B) is an upper view of the color unit 6. The scale of FIG. 7(B) is different from that of FIG. 7(A). As shown by a dotted line, the developing unit ceiling plate 66 has an engaging port 67 which engages with the supply path block 80. The supply path block 80 is engaged with the engaging port 67 so that the supply path 81Y, 81M, 81C can be disposed as shown in the drawing. Arrow A illustrated in the drawing shows a sliding direction of the slide door 30*i* when it is opened and closed. In this connection, the residual toner deposited on the toner passage 30*f* or the agitating screw drops by the oscillation of the image forming apparatus, and the dropped toner is deposited onto the side of the dropping hole 30*g* of the slide door 30*i*. The toner deposited on the slide door 30*i* is separated from the slide door 30*i* in accordance with the opening and closing motion of the slide door 30*i*. When the supply path 81Y, 81M, 81C is disposed in the direction of arrow A, the dropping hole 30*g* corresponding to the supply path 81Y, 81M, 81C is also arranged in the direction of arrow A. When the dropping hole 30*g* is arranged in the direction of arrow A, toner accommodated in a different toner cartridge is mixed with toner located in the same portion of the slide door 30*i*, and this mixed toner is separated from the slide door when it is opened and closed. Then the mixed toner is dropped into the supply path 81 (Y, M, C). In this way, toners of different colors are mixed. In order to solve the above problems, in this embodiment, the supply path 81Y, 81M, 81C is arranged in such a manner that the engaging hole 67 is not aligned in the direction of the opening and closing direction A of the slide door 30*i*. On the assumption that an imaginary straight line is drawn in the direction of the opening and closing direction of the slide door 30*i*, the engaging ports 67 are arranged in such a manner that the imaginary straight line can not cross the two engaging ports 67. Due to the foregoing, color mixture of toner can be prevented.

According to the supply path 81Y, 81M, 81C of the present embodiment, toner is dropped from the dropping hole 30*g* to the agitating screw 61 (Y, M, C). Therefore, a quantity of conveyed toner coincides with a quantity of toner newly conveyed to the dropping hole 30*g*.

Figure 7C:
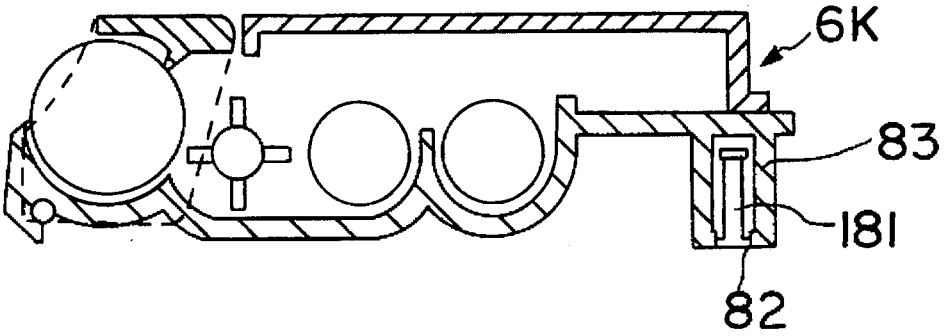
FIG. 7(C) is an arrangement view of the developing unit K.

In FIG. 7(A), the pin 181 is used for positioning the color unit 6 to the support frame. Therefore, the pin 181 functions as a developing unit lock mechanism. The pin 181 is detachably inserted into the pin accommodating hole 83 provided in the color unit 6 through the pin insertion hole 82. The support frame is provided with a bottom plate support plate, and the developing device bottom plate 65C, which is the bottom plate of the entire developing unit of this embodiment, is set on the bottom plate support plate. On the bottom support plate, there is provided an engaging hole to be engaged with the pin 181 when the color unit 6 is put at a predetermined position of the support frame. When the pin 181 is engaged with the engaging hole on the bottom support plate, even if a clearance is set between the color unit 6 and the support frame, the cartridge body is not displaced when it is subjected to vibration. The pin 181 of the developing device 6K shown in FIG. 7(C) prevents a displacement of the cartridge body caused by vibration in the same manner. Since the pin 181 is detachably provided, the pin 181 is accommodated in the pin accommodating hole 83 so that the color unit 6 or the developing device 6K can be smoothly attached to the apparatus.

Prevention of the displacement of the cartridge body can be accomplished by not only the pin 181 but also other locking mechanisms.

FIGS. 8(A) to 8(C) are views of other embodiments of the color unit of the present invention. FIGS. 8(A) and 8(B) are upper face views of embodiments of the color unit which are different from each other.

On the developing unit ceiling plate 66 shown in FIG. 8(A), there are provided two openings. One is an opening 81YA corresponding to the supply path 81Y, and the other is an engaging port 67A with which the supply path block 80A having the supply paths 81MA, 81CA is engaged. The opening 81YA is arranged immediately above the agitating screw 61Y and at a position opposed to the dropping hole **30*g* of yellow toner. Through the supply path block 80A, the supply paths 81MA, 81CA are penetrated so that toner can not be mixed. In the color unit 6A, the developing devices are separated from each other so that toners of different colors can not be mixed with each other. The supply path 81CA penetrates the developing device bottom plate 65M, and cyan toner is supplied to the agitating screw 61C through the supply path 81CA**.

In FIG. 8(B), the supply path block 80CB protrudes from a side wall surface of the developing unit. The supply path 81CB, which is a cyan toner supply path, penetrates the supply path block 80CB. Cyan toner is supplied to the agitating screw 61C of the developing device 6C through an opening provided on the side surface of the developing unit. The supply path block 80MB protrudes from a wall surface shown on the right of the developing unit in the drawing. The supply path 81MB, which is a path of magenta toner, penetrates the supply path block 80MB. Magenta toner is supplied to the agitating screw 61M of the developing device 6M through an opening formed on the side wall surface of the developing unit. Both the supply path blocks 80CB and 80MB are integrally fixed to the developing unit. They are integrally attached to and detached from the apparatus together with the developing unit. The opening 81YB is arranged immediately above the agitating screw 61Y. The opening 81YB corresponds to the supply path 81Y.

In FIG. 8(C), the supply path 81YD is arranged immediately above the agitating screw 61Y. The supply path 81YD corresponds to the supply path 81Y. The supply path 81MD is formed integrally with the developing device bottom plate 65Y. The supply path 81MD penetrates the developing unit ceiling plate 66 of the developing unit 6D and the developing device bottom plate 65Y. The supply path 81CD penetrates the developing device bottom plates 65M and 65C. When the developing device 6C is put on the developing device 6M, the supply path 81CD functions as a supply path which penetrates the developing unit ceiling plate 66 and the developing device bottom plate 65M. On the developing unit ceiling plate 66, there are provided a supply path 81MD and a receiving port 62 of the supply path 81CD.

As described above, in the image forming apparatus, there is provided a conveyance means composed of a flexible connecting pipe or a pipe type connecting pipe. When this conveyance means is arranged in a region of the width of the recording sheet conveyance direction and toner is supplied to the developing devices 6 (Y, M, C) of the developing unit by the supply path 81Y, 81M, 81C toner is supplied to all developing devices of the developing unit by the supply path 81Y, 81M, 81C. Due to the foregoing, it is possible to provide an image forming apparatus in which the toner supply system composed of a toner cartridge 17, toner hopper 31 and toner passage **30*f*** is arranged in a region of the width of the developing unit.

In this embodiment, the supply path 81Y, 81M, 81C is arranged in such a manner that the receiving ports 62 are disposed on the approximately same horizontal surface of the developing cartridge ceiling plate 66. Accordingly, when the single slide door **30*i* is opened or closed, all the receiving ports 62** are simultaneously opened or closed by one operation. Therefore, the mechanical reliability is enhanced.

In the above embodiments, in order to make the agitating time of the agitating screws 61 (Y, M, C) to be the same, the receiving ports 62 are arranged on one surface of the developing unit, and the dropping holes **30*g* are locally arranged in a portion on the receiving floor 30*e* so that they correspond to the receiving ports 62**.

According to the image forming apparatus mentioned above, the through-hole can be formed integrally with the developing unit, consequently the conveyance path such as a connection pipe is not required to provide additionally. The apparatus has the constitution that after the toner is conveyed halfway by the conveyance means, the toner drops naturally. Accordingly, it is not necessary to provide a compulsive conveyance means such as a screw on the through-hole. That is, after the toner is conveyed directly to each of the developing devices through the through-hole, the distribution of the toner is conducted by the developing units. Therefore, a screw pouring forcibly the toner into the developing device is not required. Since it is not necessary to bend the conveyance direction of the toner conveyance path by using a tube, the radius of the curvature and the conveyance force is not required to consider, and the proper conveyance force can be maintained with this compact and small sized constitution. In addition, the wear inside the conveyance path can be made small.

Furthermore, even in the case that the developing unit is held on the carriage, since the toner inside the through-hole simply drops, it is not necessary to remove the conveyance means or the conveyance path when the developing unit is detached or attached. The developing unit only can be easily detached from or attached to the carriage.

Moreover, the toner can be conveyed in the horizontal direction, thereby the upper part of the developing unit can be made compact. As the conveyance path can be constituted using only upper surface of the developing unit, the conveyance path on the side surface of the developing unit is not required, thereby the part of side surface of the developing unit can be made compact.

Further, the toner dropping positions of the plurality of toner conveyance means are close to each other, it is possible to align the plurality of toner supply sources transversely. In this case, it is possible to prevent the toner from spilling over from the toner dropping ports, from which toner is supplied to the plurality of developing devices, by sliding one slide door. Therefore, the image forming apparatus can be made compact and the cost can be reduced. It is possible to easily replace a plurality of toner supply sources and developing devices, and further the maintenance can be easily carried out.

What is claimed is:

1. An image forming apparatus comprising:

(a) a plurality of toner storage devices for storing different toner;

(b) a developing unit integrally containing a plurality of developing devices which are vertically aligned, said plurality of developing devices substantially overlapping each other in a vertical direction;

(c) each said toner storage device being associated with one of said developing devices; and (d) a toner conveyance device associated with each said toner storage device for conveying toner from said toner storage device to the developing device associated with said toner storage device, wherein through-holes are formed in the developing unit, and an upper portion of each of the through-holes is connected with each of the plurality of toner conveyance devices in such a manner that an upper opening of each of the through-holes is opposed to an ejection port of each of the plurality of toner conveyance devices, so that toner drops from each of the plurality of toner conveyance devices into each of the through-holes and is guided to each of the plurality of developing devices, and further comprising a carriage for supporting the developing unit, wherein the plurality of toner conveyance devices are provided on the carriage, and wherein the developing unit is detachably attachable to the carriage.

2. The apparatus of claim 1, wherein the plurality of conveyance devices are disposed on an upper part of the developing unit, and each of the plurality of conveyance devices conveys toner along an upper face of the developing unit in a substantially horizontal direction and guides the toner onto the corresponding through-hole.

3. The apparatus of claim 1, wherein each of the plurality of toner storing devices comprises a toner cartridge containing toner therein and a toner hopper, wherein the toner cartridge is disposed such that a longitudinal direction thereof is substantially horizontal, the toner is conveyed to the toner hopper in the longitudinal direction, wherein each of the toner conveyance devices conveys the toner in the toner hopper onto the developing unit, and wherein the toner cartridge and the toner hopper are substantially disposed on the developing unit.

4. The apparatus of claim 1 further comprising a plurality of supply paths provided along the plurality of the conveyance means, for conveying toner, wherein the developing unit further comprises partition walls for isolating the plurality of developing devices from each other, and wherein the plurality of supply paths pass through the partition walls.

5. The apparatus of claim 1, wherein the plurality of developing devices are stacked on each other, and the through-holes are formed on an upper cover of an uppermost developing device.

6. The apparatus of claim 1 further comprising a plurality of toner supply sources, wherein the carriage supports the plurality of developing devices and a plurality of toner supply sources so that the plurality of developing devices are located below the plurality of toner supply sources.

7. The apparatus of claim 6, wherein the plurality of toner conveyance devices convey toners substantially horizontally and drop the toners into the through-holes of the developing unit.

8. The apparatus of claim 7, wherein toner dropping positions of the plurality of toner conveyance devices are close to each other.

9. An image forming apparatus comprising:

(a) a plurality of toner storage devices for storing different toner;

(b) a developing unit integrally containing a plurality of developing devices;

(c) each said toner storage device being associated with one of said developing devices; and (d) a toner conveyance device associated with each said toner storage device for conveying toner from said toner storage device to the developing device associated with said toner storage device, wherein through-holes are formed in the developing unit, and an upper portion of each of the through-holes is connected with each of the plurality of toner conveyance devices in such a manner that an upper opening of each of the through-holes is opposed to an ejection port of each of the plurality of toner conveyance devices, so that toner drops from each of the plurality of toner conveyance devices into each of the through-holes and is guided to each of the plurality of developing devices, and further comprising a carriage for supporting the developing unit, wherein the plurality of toner conveyance devices are provided on the carriage, and wherein the developing unit is detachably attachable to the carriage.

* * * * *